US006131319A

United States Patent [19]

Fagan

[11] Patent Number: 6,131,319

[45] Date of Patent: Oct. 17, 2000

[54] ADVERTISING DISPLAY

[76] Inventor: Derrell Fagan, 1190 Lionsgate La., Gulf Breeze, Fla. 32561

[21] Appl. No.: 09/416,707

[22] Filed: Oct. 12, 1999

Related U.S. Application Data

[62] Division of application No. 08/840,858, Apr. 17, 1997, Pat. No. 5,983,544.

[51] Int. Cl.[7] ..... G09F 7/22

[52] U.S. Cl. ..... 40/584; 52/27.5

[58] Field of Search ..... 379/447, 450, 379/451; 49/398, 399; 52/27.5, 32, 65, 585.1; 312/139.1, 117, 118; 40/584, 605, 733, 481

[56] References Cited

U.S. PATENT DOCUMENTS

| | | | |
|---|---|---|---|
| 1,388,010 | 8/1921 | Watson | 40/781 X |
| 5,031,366 | 7/1991 | Cameron | 52/27 |
| 5,564,486 | 10/1996 | Deigman | 160/113 |

*Primary Examiner*—Joanne Silbermann
*Attorney, Agent, or Firm*—Peter Loffler

[57] ABSTRACT

An advertising display for displaying advertising messages on a telephone booth has a pair of side mounts pivotally attached to the telephone booth and a bottom mount attached to the telephone booth. Each side mount and the bottom are comprised of a pair of generally coextensive panels either hingedly or non-hingedly attached to one another with the front panel being transparent. The advertising can be placed directly on the rear panel or an appropriate insert positioned between coextensive panels.

8 Claims, 3 Drawing Sheets

ADVERTISING DISPLAY

This is a divisional application of U.S. patent application 08/840,858, filed on Apr. 17, 1997, now U.S. Pat. No. 5,983,544.

BACKGROUND OF THE INVENTION

1. Field of the Invention

The present invention relates to an advertising display usable with existing telephone booths.

2. Background of the Prior Art

For only a short time, a public telephone booth has a captive audience in the user of the phone. Therefore, the phone booth is an ideal candidate to present an advertising message to the telephone user. During the dialing process, the wait during the ring, the endless hold, or the labyrinth of a voice messaging system that a user endures, the user can be exposed to an advertising message that serve as welcome distraction. Even during a phone call, wherein the caller is concentrating completely on the call, an advertiser will be able to effectively place an advertising message before the user.

Recognizing the value of public telephone advertising display systems, many devices have been proposed. U.S. Pat. No. 4,918,878 to Paschke et al., U.S. design patent D263,101 to George et al., and U.S. patents and U.S. Pat. Nos. 4,754,582, 4,961,294, and 5,031,366 to Cameron are a few of the many examples of prior art advertising display systems for public telephone booths. While these and other prior art display systems are effective at delivering an advertising message to a user of a telephone booth, they all require redesign of the telephone booth itself. Although a redesigned telephone booth may be an option for newly installed booths, it is not a financially viable option for the large number of public telephone booths already in place. Preexisting telephone booths require an advertising display system that can be retrofitted onto the booth.

Therefore, there is a need in the art for a public telephone booth advertising display system that can be utilized with existing telephone booth technology. Such a system should be of relatively simple design and construction. The system should be easy to use and maintain and should require very little change to the telephone booth.

SUMMARY OF THE INVENTION

The advertising display of the present invention addresses the aforementioned needs in the art. The advertising display is comprised of a pair of side mounts each comprised of a transparent front panel and a generally coextensive rear panel pivotally attached to telephone booth, proximate the inner sides of the booth. A bottom mount is comprised of a transparent front panel and a generally coextensive rear panel attached to the telephone booth proximate the inner bottom area. Advertising can be placed directly upon each of the rear panels and viewed through the transparent front panels, or can be placed onto appropriate sized inserts that are positionable between a front panel and the corresponding rear panel.

The advertising display is of simple design and relatively simple and inexpensive construction. It is easy to install and does not require changes to existing telephone booths. The advertising display allows a plurality of advertising messages to be displayed to a person using the phone booth or to a person passing by the booth. The present invention does not permit public access to the advertising displays thereby prohibiting unauthorized changes to or removals of advertising messages. The device permits rapid replacement of advertising messages by authorized personal.

BRIEF DESCRIPTION OF THE DRAWINGS

Similar reference numerals refer to similar parts throughout the several views of the drawings.

DESCRIPTION OF THE PREFERRED EMBODIMENT

Figure 3:
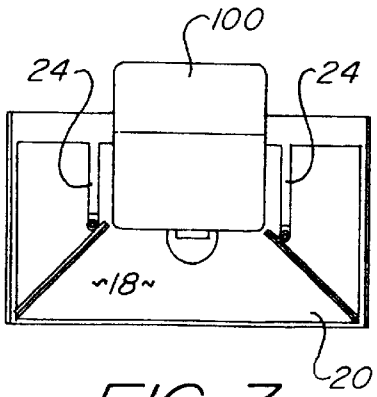
FIG. 3 is a top plan view of the advertising display of the present invention installed on the telephone booth.
Figure 2:
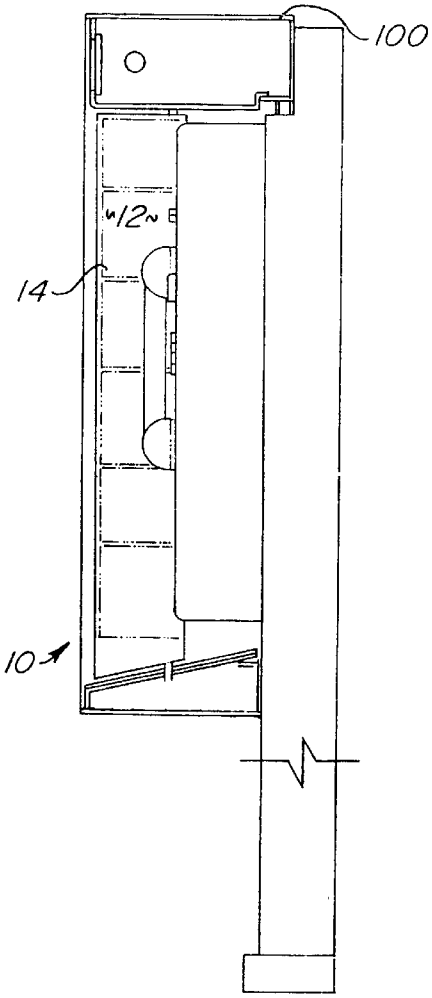
FIG. 2 is a side elevation view of the advertising display of the present invention installed on the telephone booth.
Figure 1:
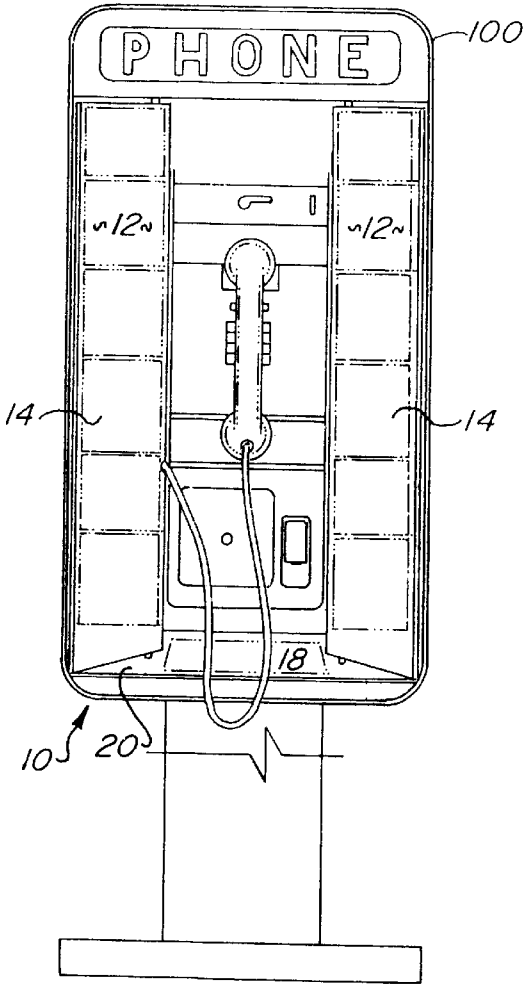
FIG. 1 is a a front elevation view of the advertising display of the present invention installed on a telephone booth.
Figure 5:
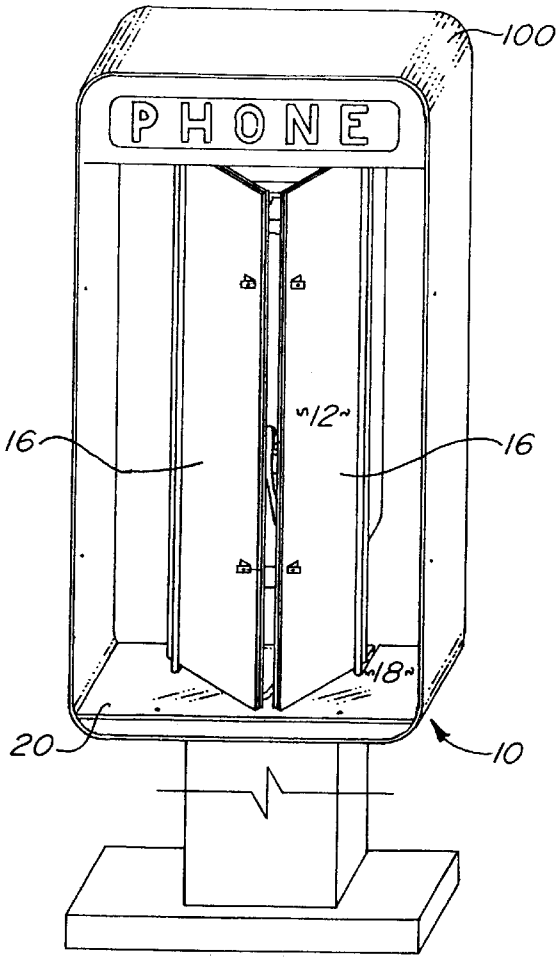
FIG. 5 illustrates the articulating ability of the side mounts of the advertising display.
Figure 4:
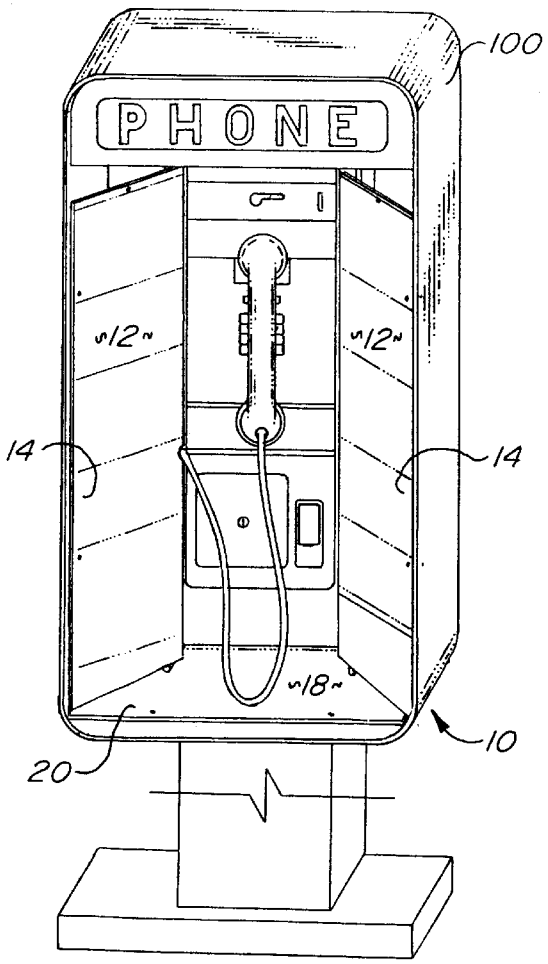
FIG. 4 is a perspective view of the advertising display of the present invention installed on the telephone booth.
Figure 6:
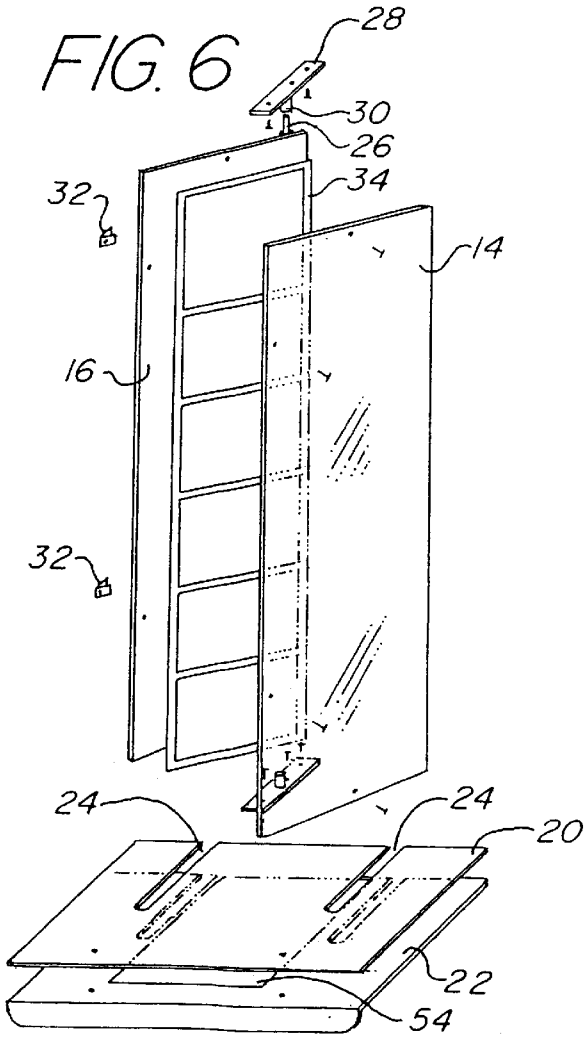
FIG. 6 is an exploded view of one of the side mounts and the bottom mount of the advertising display of the present invention.

Referring now to the drawings, it is seen that the advertising display of the present invention, generally denoted by reference numeral 10, is comprised of a pair of side mounts 12. Each side mount 12 is comprised of a front panel 14 and a generally coextensive rear panel 16. The front panel 14 may be hingedly attached to the rear panel 16, or, as illustrated in FIG. 6, the front panel 14 may be separate from the rear panel 16. Each back panel 16 may be opaque, such as being a solid color, black or otherwise, while each front panel 14 is transparent.

A bottom mount 18 is comprised of a front panel 20 and a rear panel 22. The front panel 20 may be hingedly attached to the rear panel 22, or, as illustrated in FIG. 6, the front panel 20 may be separate from the rear panel 22. The rear panel 22 may be opaque, such as being a solid color, black or otherwise, while each front panel 20 is transparent. As seen, the bottom mount has a pair of coextensive openings 24 extending from the rear portion of each panel 20 and 22 and terminating prior to the front of each panel 20 and 22.

Advantageously, the side mounts 12 and the bottom mount 18 will be made from a durable lightweight material, such as LUCITE™, LEXAN™, or the like.

A pair of mounting rods 26 is attached to the rear panels 16 of the side mount 12, proximate the inside vertical edge, one mounting rod 26 attached to each rear panel 16. Each mounting rod 24, which extends above and below the edges of the rear panel 16 and which may be disjoint in the medial portion, may be completely constructed from a durable lightweight material, or may be made from a metal core that is inserted into a durable lightweight material such as PVC or the like. Each mounting rod 26 will be attached to its respective side mount 12 in any appropriate fashion.

Two pairs of mounting brackets 28 are attached to each side of a telephone booth 100, two mounting brackets 28 each on the lower portion of the telephone booth 100 on opposing sides, and two mounting brackets 28 each on the upper portion of the telephone booth 100 on opposing sides. Each mounting bracket 28 is attached to telephone booth 100 in any desired fashion including boltable attachment through existing holes on the telephone booth 100. As seen in FIG. 6, each mounting bracket 18 has a grommet 30 thereon. Each grommet 30 receives one end of a mounting rod 26.

A plurality of attachment brackets 32, such as L-brackets, are attached to the telephone booth 100 at appropriate strategic points on the telephone booth 100.

In order to utilize the advertising display 10 of the present invention, advertising is attached to each rear panel 16 and 22 such that it is sandwiched between and visible through the corresponding front panel 14 and 20. Alternately, a pair of side inserts 34 and a bottom insert 36 can be utilized such that the advertising is attached to the inserts 34 and 36 and each insert is positioned between a mount—side inserts 34 positioned between the front panel 14 and the back panel 16 of a side mount 12 and the bottom insert 36 positioned between the front panel 20 and the back panel 22 of the bottom mount 18. The ends of each mounting rod 26 are pivotally positioned within a grommet 30 and each side mount 12 is secured to the attachment bracket 32 in appropriate fashion such as boltable attachment, it being expressly recognized that the side mounts 12 can be attached directly to the telephone booth 100 with the use of appropriate spacers (not illustrated) thereby dispensing with the need for the attachment brackets 32. The bottom mount 18 is positioned within the telephone booth 100 such that the lower portion of each mounting rod 26 is received within one of the openings 24 on the bottom mount 18. The bottom mount is secured to the attachment brackets 32 in appropriate fashion such as boltable attachment, it again being expressly recognized that the bottom mount 18 can be attached directly to the telephone booth 100 with the use of appropriate spacers.

The advertising system is now complete and anyone using or passing by the telephone booth 100 will be exposed to the advertising message contained within the system 10.

In order to change the advertising display within one or both of the side mounts 12, the bolts used to secure that particular side mount 12 are removed and the front panel 14 is swung open (if hingedly attached to the back panel) or is removed from the proximity of the back panel (if the front panel 14 is not hingedly attached to the back panel 16). The advertising display to be deleted is removed from the back panel 16 or from the side insert 32 and replaced with the new display. Alternately, the side insert 32 can be completely replaced with a new display-bearing side insert 32. Thereafter, the front panel 14 is repositioned over the rear panel 16 and the side mount is reattached to the telephone booth 100. An advertising display change to the bottom mount 18 is accomplished in similar manner.

While the invention has been particularly shown and described with reference to an embodiment thereof, it will be appreciated by those skilled in the art that various changes in form and detail may be made without departing from the spirit and scope of the invention.

I claim:

1. An advertising display in combination with a telephone booth, the telephone booth comprising a body member having a top panel and a bottom panel joined by a pair of side walls, the advertising display comprising:

a pair of side mounts, each side mount comprised of a first transparent front panel and a generally coextensive first rear panel, attached to the top panel and to the bottom panel of the telephone booth in generally vertical orientation, such that each side mount is generally coextensive with a respective one of the pair of side walls of the telephone booth; and a bottom mount, comprised of a second transparent front panel and a generally coextensive second rear panel attached to the bottom panel of the telephone booth in generally horizontal or generally diagonal orientation.

2. The advertising display as in claim 1 further comprising:

four mounting brackets, each mounting bracket having a grommet and each mounting bracket attached to the telephone booth in spaced apart orientation;

a pair of mounting rods, each mounting rod attached to one of the pair of first rear panels such that each mounting rod extends above the top and below the bottom of the first rear panel to which it is attached and that each end of each of the mounting rods is received within one of the grommets.

3. The advertising display as in claim 2 wherein the bottom mount has a pair of generally coextensive openings extending from the back and terminating prior to the front and wherein each of the pair of mounting rods is received within one of the openings.

4. The advertising display as in claim 1 further comprising:

a pair of side inserts, each of the side inserts being generally coextensive with and positionable between one of the first front panels and the corresponding first rear panel; and a bottom insert generally coextensive with and positionable between the second front panel and the second rear panel.

5. The advertising display as in claim 1 wherein each of the first front panels is hingedly attached to the corresponding first rear panel.

6. The advertising display as in claim 1 wherein the second front panel is hingedly attached to the second rear panel.

7. The advertising display as in claim 1 wherein each of the first front panels is hingedly attached to the corresponding first rear panel and the second front panel is hingedly attached to the second rear panel.

8. The advertising display as in claim 1 wherein each of the side mounts is pivotally attached to the telephone booth.

* * * * *